US011635229B2

(12) United States Patent
Ryu et al.

(10) Patent No.: US 11,635,229 B2
(45) Date of Patent: Apr. 25, 2023

(54) AIR CONDITIONER

(71) Applicant: SAMSUNG ELECTRONICS CO., LTD., Suwon-si (KR)

(72) Inventors: Ji Won Ryu, Suwon-si (KR); Hyun Uk Park, Suwon-si (KR); Kyung Ho Hwang, Suwon-si (KR); Tae-In Eom, Suwon-si (KR); Jae Min Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 113 days.

(21) Appl. No.: 16/767,186

(22) PCT Filed: Nov. 21, 2018

(86) PCT No.: PCT/KR2018/014307
§ 371 (c)(1),
(2) Date: May 27, 2020

(87) PCT Pub. No.: WO2019/107823
PCT Pub. Date: Jun. 6, 2019

(65) Prior Publication Data

US 2020/0309406 A1 Oct. 1, 2020

(30) Foreign Application Priority Data

Nov. 28, 2017 (KR) ..... 10-2017-0160751

(51) Int. Cl.
*F24F 13/14* (2006.01)
*F24F 11/79* (2018.01)
(Continued)

(52) U.S. Cl.
CPC ..... *F24F 13/1426* (2013.01); *F24F 11/79* (2018.01); *F24F 13/12* (2013.01);
(Continued)

(58) Field of Classification Search
CPC ..... F24F 13/12; F24F 13/1426; F24F 13/20; F24F 13/068; F24F 11/79; F24F 2013/1446
(Continued)

(56) References Cited

U.S. PATENT DOCUMENTS 10,788,240 B2 9/2020 Lee et al.
2004/0031276 A1* 2/2004 Cho ..... F25D 17/045 62/186

FOREIGN PATENT DOCUMENTS

CN 205897474 U 1/2017
CN 107366978 A 11/2017
(Continued)

OTHER PUBLICATIONS

Mechanisms C, Four-Follower Face Cam Mechanism, Dec. 18, 2016, YouTube, https://youtu.be/enIUeNJrKY4 (Year: 2016).*
(Continued)

*Primary Examiner* — Allen R. B. Schult
(74) *Attorney, Agent, or Firm* — Staas & Halsey LLP

(57) ABSTRACT

Provided is an air conditioner including a housing including a discharge path, a first discharge wall forming the discharge path, and a second discharge wall arranged at a side opposite to the first discharge wall and an airflow controller including a guide member configured to move between a first location provided at an inside of the first discharge wall and a second location protruding outside of the first discharge wall. The air conditioner controls a discharge airflow while minimizing loss of discharge air volume through an airflow controller without using a general blade, and controls a discharge airflow of air discharged through a discharge path having a circular shape.

8 Claims, 22 Drawing Sheets

(51) Int. Cl.
*F24F 13/12* (2006.01)
*F24F 13/20* (2006.01)
*F24F 13/068* (2006.01)

(52) U.S. Cl.
CPC ..... *F24F 13/20* (2013.01); *F24F 13/068* (2013.01); *F24F 2013/1446* (2013.01)

(58) Field of Classification Search
USPC ..... 454/284
See application file for complete search history.

(56) References Cited

FOREIGN PATENT DOCUMENTS

| | | | |
|---|---|---|---|
| KR | 10-2002-0000375 | A | 1/2002 |
| KR | 10-2010-0049984 | A | 5/2010 |
| KR | 10-2016-0091290 | | 8/2016 |
| KR | 10-2017-0048128 | A | 5/2017 |

OTHER PUBLICATIONS

International Search Report dated Mar. 14, 2019, in corresponding International Application No. PCT/KR2018/014307.
Office Action dated Aug. 11, 2022, issued in Korean Application No. 10-2017-0160751.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2018/014307 filed on Nov. 21, 2018, which claims foreign priority benefit under 35 U.S.C. § 119 of Korean Patent Application 10-2017-0160751 filed on Nov. 28, 2017, in the Korean Intellectual Property Office, the contents of both of which are incorporated herein by reference

TECHNICAL FIELD

The disclosure relates to an air conditioner, and more specifically, to an air conditioner having an airflow controller.

BACKGROUND ART

An air conditioner is a device that includes a compressor, a condenser, an expansion valve, an evaporator, a fan, and the like, and using a refrigeration cycle, controls the temperature, humidity, and airflow in the room. The air conditioner may be classified into a split type air conditioner including an indoor unit installed indoors and an outdoor unit installed outdoors, and an integral type air conditioner in which an indoor unit and an outdoor unit are installed in a housing.

The air conditioner includes a heat exchanger for having a refrigerant heat-exchange with air, a fan for moving g air, and a motor for driving the fan to cool or heat the room.

The air conditioner may have a discharge airflow control device for discharging the air cooled or heated through the heat exchanger in various directions. In general, the discharge airflow control device includes a vertical or horizontal blade provided at a discharge port, and a driving device for rotationally driving the blade. That is, the indoor unit of the air conditioner adjusts the rotation angle of the blade to control the direction of the discharge airflow.

In the discharge airflow control structure using the blade, the blade may interferes with the airflow, causing the discharge volume of air to be reduced, and turbulence generated around the blade may cause flow noise to be increased.

DISCLOSURE

Technical Problem

Therefore, it is an object of the disclosure to provide an air conditioner capable of controlling the flow of a discharge air through an airflow controller without using a blade.

It is another object of the disclosure to provide an air conditioner capable of controlling the flow of air discharged from a discharge path having a circular shape.

Technical Solution

According to an aspect of the disclosure, there is provided an air conditioner including: a housing including a discharge path, a first discharge wall forming the discharge path, and a second discharge wall arranged at a side opposite to the first discharge wall; and an airflow controller including a guide member configured to move between a first location provided at an inside of the first discharge wall and a second location protruding outside of the first discharge wall.

The airflow controller may further include a driving part configured to generate a rotary power and a rotating member provided to be rotated by the driving part, wherein the guide member may be moved between the first location and the second location by the rotating member.

The rotating member may include a guide rail configured to press the guide member toward the second discharge wall or press the guide member toward the inside of the first discharge wall in accordance with rotation of the rotating member, wherein the guide member may include a guide protrusion inserted into the guide rail and moved by the guide rail.

The airflow controller may further include a first gear portion configured to transmit the rotary power of the driving part to the rotating member, wherein the rotating member may include an inner circumferential portion, an outer circumferential portion, and a second gear portion arranged on the inner circumferential portion and engaged with the gear portion, and the rotating member may be provided to be rotated by engagement of the first gear portion and the second gear portion.

The rotating member may have a ring shape, and the guide rail may extend to alternately pass through a first area on the rotating member and a second area arranged at a radial outer side of the first area on the rotating member, wherein the guide member may be disposed on the first location when the guide protrusion is disposed on the first area by the movement of the guide rail, and the guide member may be disposed on the second location when the guide protrusion is disposed on the second area by the movement of the guide rail.

The guide rail may be provided to extend from a third area arranged at a radial outer side of the second area on the rotating member to the first area, wherein the guide member, when the guide protrusion is disposed on the third area by the movement of the guide rail, may be protruded further outward from the first discharge wall than when the guide protrusion is disposed on the second area.

The guide rail while rotating in one direction or an opposite direction along with rotation of the rotating member may press the guide protrusion such that the guide protrusion reciprocates between the first area and the second area.

The airflow controller may include an auxiliary guide configured to guide a movement direction of the guide member for the guide member to perform a translation motion between the first location and the second location.

The guide member may include a first guide member, a second guide member, and a third guide member arranged along a circumferential direction of the rotating member, wherein the rotating member may include a first guide rail that presses the first guide member toward the second discharge wall or presses the guide member toward the inside of the first discharge wall, a second guide rail that presses the second guide member toward the second discharge wall or presses the guide member toward the inside of the first discharge wall, and a third guide rail that presses the third guide member toward the second discharge wall or presses the guide member toward the inside of the first discharge wall in accordance with rotation of the rotating member, and wherein the first guide member may include a first guide protrusion inserted into the first guide rail and moved by the guide rail, the second guide member may include a second guide protrusion inserted into the second guide rail and moved by the guide rail; and the third guide member may include a third guide protrusion inserted into the third guide rail and moved by the guide rail.

Each of the first, second, and third guide rails may extend to alternately pass through a first area on the rotating member and a second area arranged at a radial outer side of the first area on the rotating member, wherein each of the first, second, and third guide members may be disposed on the first location when a corresponding one of the first, second, and third guide protrusions is disposed on the first area by the movement of the corresponding guide rail, each of the first, second, and third guide members may be disposed on the second location when a corresponding one of the first, second, and third guide protrusions is disposed on the second area by the movement of the corresponding guide rail, and wherein each of the first, second, and third guide rail may extend in a different form.

The rotating member may be provided to rotate in one direction and rotate in an opposite direction in a reciprocating manner, wherein each of the first, second, and third guide protrusions may reciprocate between the first location and the second location at least one time while the rotating member performs one round of reciprocating rotation.

When the first rotating member performs one round of reciprocating rotation, the first guide member may be provided to reciprocate between the first location and the second location two times, the second guide member may be provided to reciprocate between the first location and the second location four times, and the third guide member may be provided to reciprocate between the first location and the second location one time.

The first guide rail may have one end and an other end disposed in the first area, and may be provided to pass through an area between the first area and the third area at least two times, and the second guide rail may have one end and an other end disposed in the first area, and may be provided to pass through the area between the first area and the third area at least four times.

At least one of the first, second, and third guide rails may be provided in a closed loop shape.

A discharge port formed by the discharge path may include a ring shape, the guide member may include a first guide member, a second guide member, and a third guide member arranged along a circumferential direction of the discharge port, the rotating member may include a first rotating member configured to move the first guide member, a second rotating member configured to move the second guide member, and a third rotating member configured to move the third guide member, and the driving part may include a first driving part configured to rotate the first rotating member, a second driving part configured to rotate the second rotating member, and a third driving part configured to rotate the third rotating member.

According to an aspect of the disclosure, there is provided an air conditioner including a housing including a discharge port having a ring shape, a first discharge wall forming an inner circumferential surface of the discharge port, and a second discharge wall forming an outer circumferential surface of the discharge port and an airflow controller configured to control a direction of discharge airflow discharged through the discharge port, wherein the airflow controller includes at least one guide member reciprocating between a first location provided at an inner side of the first discharge wall and a second location provided at an outside of the first discharge wall in a radial direction of the discharge port and a rotating member configured to rotate to reciprocatingly move the at least one guide member between the first location and the second location.

The rotating member may include at least one guide rail configured to guide the at least one guide member such that the at least one guide member reciprocates between the first location and the second location, and when the rotating member rotates in one direction and then reciprocatingly rotates in the opposite direction, the at least one guide member is caused to reciprocate between the first location and second location at least one time by the at least one guide rail.

In addition, the at least one guide member may include n guide members, and the at least one guide rail may include n guide rails to correspond to the n guide members, and the n guide rails may guide the n guide members such that each of the n guide members is disposed in the first location or the second location in a total number of 2' cases during one round of reciprocating rotation of the rotating member.

In addition, the guide member includes a plurality of guide members, and during one round of reciprocating rotation of the rotating member, each of the guide members is disposed at the first location when the rotating member rotates a first angle from a start position of the rotation, each of the guide members is disposed at the second location when the rotating member rotates a second angle from the start position, and at least one of the guide members is disposed at the first location and the remaining is disposed at the second location when the rotating member rotates a third angle from the start position.

According to an aspect of the disclosure, there is provided an air conditioner including a housing including a discharge port and an airflow controller configured to control the direction of a discharge airflow discharged through the discharge port, wherein the airflow controller includes at least one guide member configured to move between a first location provided at an outside of the discharge port and a second location provided on the discharge port, a single rotating member configured to rotate to reciprocatingly move the at least one guide member between the first location and the second location, and a single driving part configured to rotate the single rotating member.

Advantageous Effects

As is apparent from the above, the air conditioner can control a discharge airflow while minimizing loss of discharge air volume through an airflow controller without using a general blade.

The air conditioner can control a discharge airflow of air discharged through a discharge path having a circular shape.

BEST MODES OF THE DISCLOSURE

Figure 1:
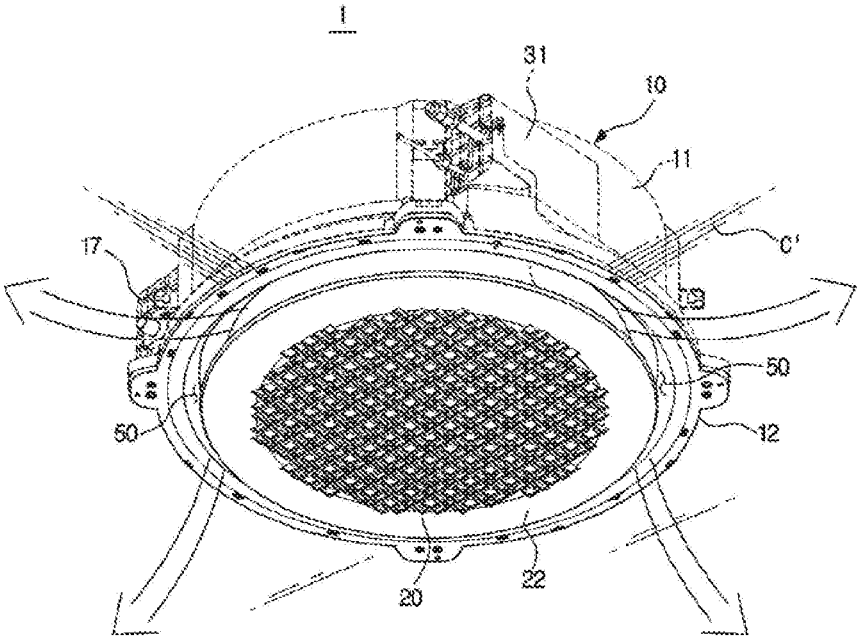
FIG. 1 is a perspective view illustrating an air conditioner according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, embodiments according to the disclosure will be described in detail with reference to the accompanying drawings.

Figure 2:
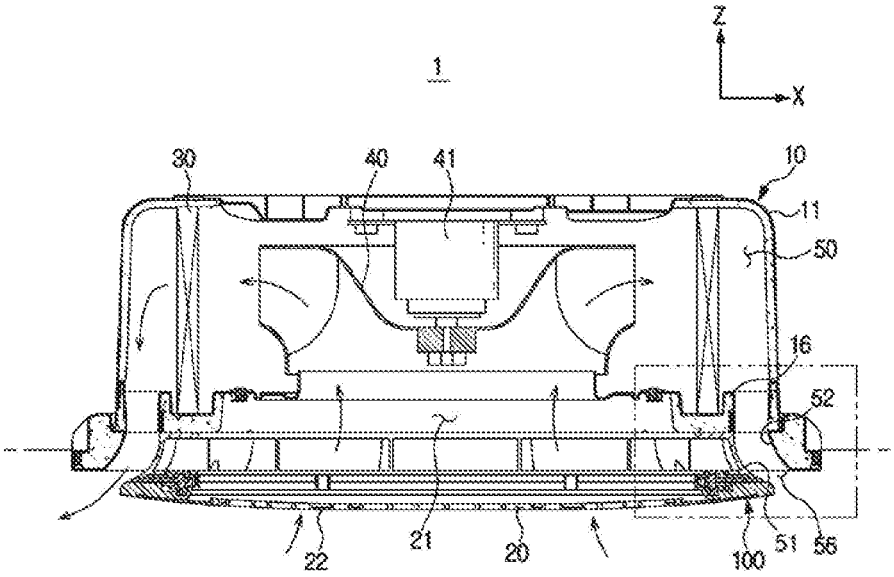
FIG. 2 is a side cross-sectional view illustrating the air conditioner shown in FIG. 1.
Figure 3:
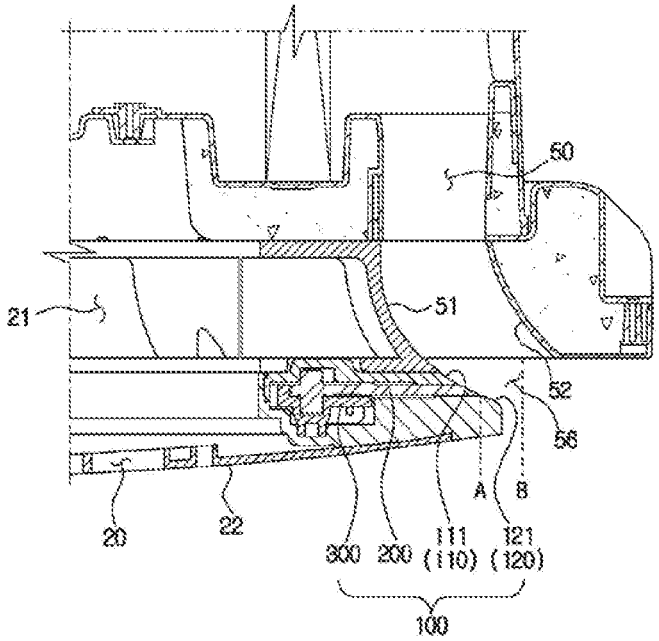
FIG. 3 is an enlarged side cross-sectional view illustrating a part of the air conditioner shown in FIG. 2.
Figure 4:
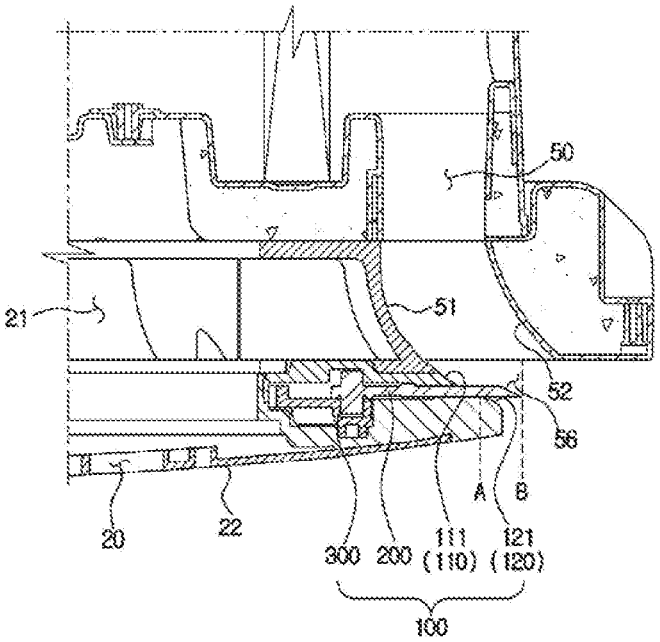
FIG. 4 is an enlarged side cross-sectional view illustrating a part of the air conditioner shown in FIG. 2.

FIG. 1 is a perspective view illustrating an air conditioner 1 according to an embodiment of the disclosure. FIG. 2 is a side cross-sectional view illustrating the air conditioner 1 shown in FIG. 1. FIG. 3 is an enlarged side cross-sectional view illustrating a part of the air conditioner 1 shown in FIG. 2. FIG. 4 is an enlarged side cross-sectional view illustrating a part of the air conditioner 1 shown in FIG. 2.

The air conditioner 1 may be installed on a ceiling C'. At least a portion of the air conditioner 1 may be buried in the ceiling C'.

The air conditioner 1 may include a housing 10 provided in a substantially cylindrical shape, a heat exchanger 30 provided inside the housing 10, and a fan 40 causing to flow air.

The housing 10 may have an approximately circular shape when viewed in the vertical direction. However, the disclosure is not limited thereto, and may have an elliptical shape or a polygonal shape. The housing 10 includes an upper housing 11 disposed inside the ceiling C', and a lower housing 12 coupled to the bottom of the upper housing 11 and disposed outside the ceiling C' to be exposed to the outside. However, the disclosure is not limited thereto, and an additional intermediate housing may be disposed between the upper housing 11 and the lower housing 12.

In the central portion of the lower housing 12, a suction port 20 through which air is sucked is disposed, and on the upper side of the suction port 20, a suction passage 21 connecting the suction port 20 to the fan 40 may be provided so that air sucked through the suction port 20 flows to a side of the fan 40.

On the radial outer side of the suction port 20 and on the radial outer side of the heat exchanger 30, a discharge path 50 is provided so that air sucked through the suction port 20 is heat-exchanged by the heat exchanger 30 and discharged. The discharge path 50 may have an approximately annular shape when viewed in the vertical direction. However, the disclosure is not limited thereto, and the discharge path 50 may be provided to include a curved section.

The discharge path 50 may be provided in an annular shape due to the heat exchanger 30 provided in an annular shape and the housing 10 provided in a cylindrical shape. One side of the discharge path 50 may be connected to the heat exchanger 30 and the other side of the discharge path 50 may be connected to a discharge port 56 provided at a side of the lower housing 12.

With such a structure, the air conditioner 1 may suck air from the lower side, cool or heat the air, and then discharge the air back to the lower side.

The suction port 20 may be formed on a circular suction panel 22 that is formed to have a diameter approximately corresponding to that of the suction passage 21. A plurality of the suction ports 20 may be formed on the suction panel 22. A grille (not shown) may be coupled to the upper side of the suction panel 22 to filter out dust from the air sucked into the suction port 20.

The heat exchanger 30 may be provided inside the housing 10 and may be disposed on an air passage between the suction port 20 and the discharge port 56. The heat exchanger 30 may include a tube (not shown) through which a refrigerant moves, and a header (not shown) connected to an external refrigerant pipe to supply or recover a refrigerant to or from the tube. The tube may be provided with a heat exchange fin to enlarge the heat dissipation area.

The heat exchanger 30 may have an approximately annular shape when viewed in the vertical direction. The shape of the heat exchanger 30 may be provided to correspond to the shape of the housing 10. The shape of the heat exchanger 30 may be provided to correspond to the shape of the discharge port 56. The heat exchanger 30 is placed on a drain tray 16 so that condensate generated in the heat exchanger 30 may be collected in the drain tray 16.

The fan 40 may be provided on a radial inner side of the heat exchanger 30. The fan 40 may be a centrifugal fan that sucks air in an axial direction and discharges the air in a radial direction. The air conditioner 1 may be provided with a blower motor 41 for driving the fan 40.

With such a configuration, the air conditioner 1 may suck the air in the room, cool the air, and discharge the cooled air into the room, or may suck the air in the room, heat the air, and discharge the heated air to the room.

The air conditioner 1 may further include a heat exchanger pipe 31 connected to the heat exchanger 30 from the outside of the housing 10 and through which a refrigerant flows and a drain pipe 17 discharging condensate collected in the drain tray 16 to the outside. The heat exchanger pipe 31 and the drain pipe 17 may pass through one side of the upper housing 11 so as to be connected to the outside.

As described above, the air conditioner 1 according to the embodiment of the disclosure includes the discharge path 50 formed in an annular shape, and includes the discharge port 56 in an annular shape, at least a portion of which corresponds to the annular shape discharge path 50.

The discharge path 50 may include first and second discharge walls 51 and 52 provided on a lower portion thereof and forming the discharge path 50 in annular shape. In the upper portion of the discharge path 50, an annular space is formed by an inner circumferential surface of the upper housing 11 and the heat exchanger 30, and an annular space is formed by the first discharge wall 51 and the second discharge wall 52 in the lower housing 12, of the discharge path 60 positioned below the heat exchanger 30. That is, the first discharge wall 51 may form the inner circumferential surface of the discharge path 50 and the second discharge wall 52 may form the outer circumferential surface of the discharge path 50.

However, the disclosure is not limited to one embodiment, and the first discharge wall 51 and the second discharge wall 52 may extend from the upper housing 11, and although not shown, may extend from another part, such as an intermediate housing that may be provided between the upper housing 11 and the lower housing 12. In addition, the first discharge wall 51 and the second discharge wall 52 may be formed through separate configurations.

The first discharge wall 51 and the second discharge wall 52 may each include a curved portion 53 provided in a curved shape and extending in a radially outer direction of the discharge path 50. The curved portion 53 may be provided on a side adjacent to the discharge port 56.

Air discharged through the discharge path 50 to the discharge port 56 may be discharged in a direction in which the curved surface is curved along the curved portion 53. Therefore, the air discharged from the discharge port 56 may be discharged to the outside of the housing 10 along the radially outer direction of the discharge path 50 which is a direction in which the curved portion 53 extends.

In some cases, the air conditioner 1 needs to selectively form a wide airflow in which air spreads in all directions and a downward airflow in which discharge airflow are concentrated downward. In this case, the air conditioner 1 according to the embodiment of the disclosure mostly forms a downward airflow, and has a difficulty in controlling the discharge airflow.

In the existing air conditioner, the housing and the heat exchanger are provided in a quadrangular shape, and accordingly, the discharge port is formed in a quadrangular shape. As the discharge port is provided in a quadrangular shape, the discharge port is not disposed to cover the entire radial outer side of the heat exchanger along the circumference of the heat exchanger. Accordingly, a section in which the discharge airflow is discharged is restricted, and a side where the discharge port is not disposed forms a blind spot in which airflow is not smoothly transmitted.

However, in the air conditioner 1 according to the embodiment of the disclosure, the discharge path 50 is provided in an annular shape and the discharge port 56 including an annular form corresponding in shape to that of the discharge path 50 allows airflow to be transferred in all directions without a blind spot.

As described above, the discharge port of the air conditioner according to the embodiment of the disclosure includes a form having an annular shape, unlike the existing air conditioner, and thus has difficulty in installing a blade disposed at an inside of the discharge port and controlling the discharge airflow. This is because it is inefficient to dispose a blade shaft at an annular shaped discharge port, having a difficulty in rotating the blade in the discharge port. Accordingly, the air conditioner 1 including the discharge path 50 in annular shape according to the embodiment of the disclosure needs to use a configuration other than the blade when controlling the discharge airflow discharged to the discharge port 56.

To this end, the air conditioner may drive an airflow controller 100 to control the discharge airflow. In detail, the air conditioner including the blade varies the arrangement angle of the blade to control the downward airflow and the wide airflow, while the air conditioner 1 according to the embodiment of the disclosure drives the airflow controller 100 to control the downward airflow and the wide airflow.

In addition, as the discharge airflow is controlled without using a blade as in the embodiment of the disclosure, an airflow is not obstructed by the blade, thereby preventing the volume of discharge airflow from being decreased and preventing the flow noise from being increased.

In detail, as shown in FIG. 3, when the airflow controller 100 controls the discharge airflow as a downward airflow, a guide member 200 of the airflow controller 100 is disposed at an inside of the first discharge wall 51. Accordingly, the airflow controller 100 does not restrict a flow of discharge airflow formed downward. That is, the position of the guide member 200 disposed at an inside of the first discharge wall 51 may be referred to as a first location A, and when the guide member 200 is disposed at the first location A, the air conditioner 1 may form a downward airflow.

The airflow controller 100 may be disposed at a side of the first discharge wall 51. In detail, the airflow controller 100 has an annular shaped form (see FIG. 5), and may be disposed at a lower end of the first discharge wall 51 having an annular shape. However, the disclosure is not limited thereto, and the airflow controller 100 may be disposed at an approximately middle portion of the first discharge wall 51 in the vertical direction, and the airflow controller 100 itself may form a part of the first discharge wall 51.

Therefore, the outer circumferential surface of the airflow controller 100 may have a curved surface corresponding to a curved surface of the first discharge wall 51, and the outer circumferential surface of the airflow controller 100 itself may be formed as a part of the first discharge wall 51. Accordingly, the outer circumferential surface of the airflow controller 100 may also guide the discharge airflow together with the first discharge wall 51.

The guide member 200 of the airflow controller 100 controls the direction of the discharge airflow discharged from the discharge port 56 while moving between the inside and outside of the first discharge wall 51 in the radial direction of the discharge port 56.

As disclosed in FIG. 4, when the airflow controller 100 controls the discharge airflow as a wide airflow, the guide member 200 of the airflow controller 100 is protruded outside of the first discharge wall 51 so that the guide member 200 is disposed on the discharge port 56. Accordingly, the airflow controller 100 may restrict the flow of the discharge airflow formed downward and allow the downward discharge airflow to collide with the guide member 200, causing the flow of the downward airflow to be directed to the lateral sides.

That is, the position of the guide member 200 disposed at an outside of the first discharge wall 51 may be referred to as a second location B, and when the guide member 200 is disposed at the second location B, the air conditioner 1 may form a wide airflow.

The airflow controller 100 may control the direction of the discharge airflow by arranging the guide member 200 at the first location A or the second location B. Therefore, the guide member 200 may reciprocate between the first location A and the second location B. The reciprocating movement of the guide member 200 will be described in detail below.

Hereinafter, the airflow control guide unit 100 will be described in detail.

Figure 5:
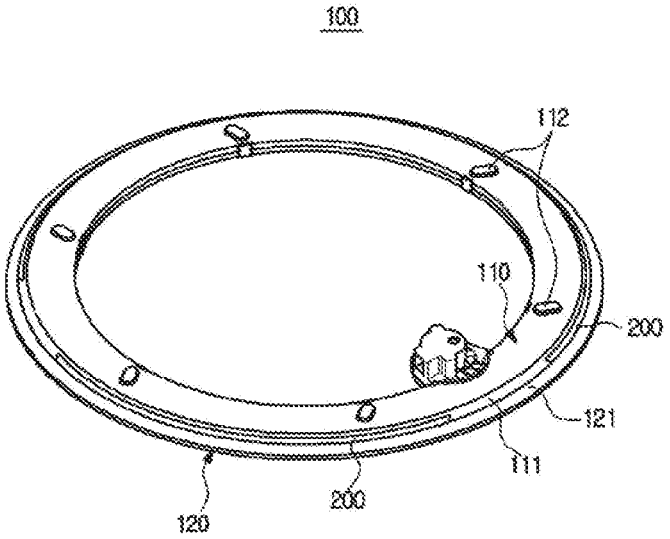
FIG. 5 is a perspective view illustrating an airflow controller of the air conditioner according to the embodiment of the disclosure.
Figure 6:
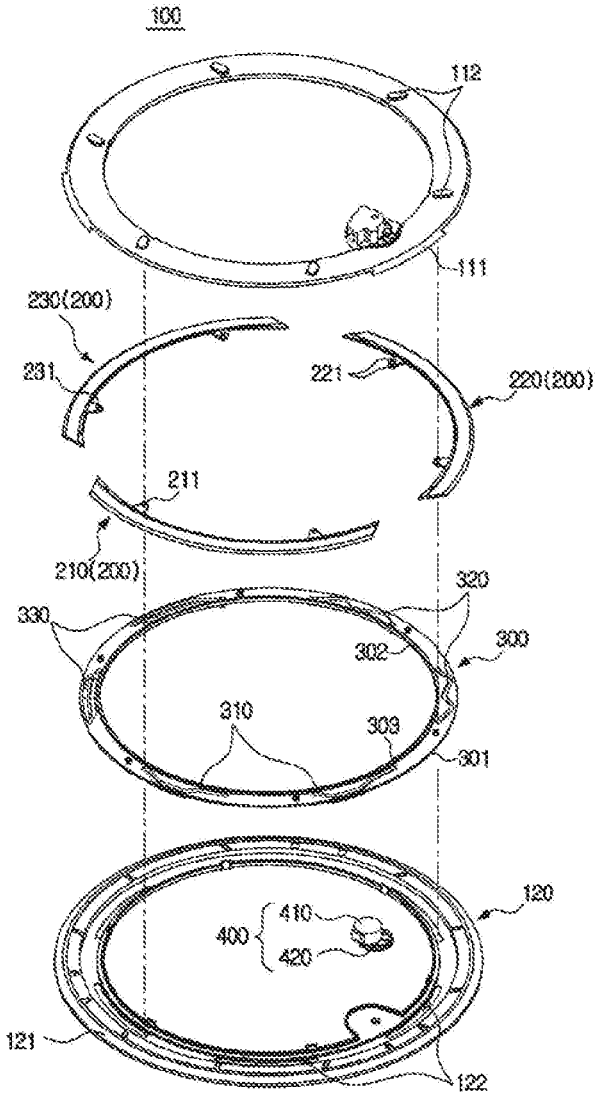
FIG. 6 is an exploded perspective view illustrating the airflow controller of the air conditioner according to the embodiment of the disclosure.

FIG. 5 is a perspective view illustrating an airflow controller of the air conditioner according to the embodiment of the disclosure. FIG. 6 is an exploded perspective view illustrating the airflow controller of the air conditioner according to the embodiment of the disclosure. FIGS. 7A to 7C and FIG. 8 are views illustrating the guide member of the air conditioner according to the embodiment of the disclosure, which show the guide member moved by a rotating member.

Referring to FIGS. 5 and 6, the airflow controller 100 may include a form of an annular shape. The outer circumferential surface of the airflow controller 100 may be provided to be disposed at the lower end of the first discharge wall 51 as described above. In addition, the airflow controller 100 may include a hollow and the suction passage 21 of the air conditioner 1 may be formed in the hollow of the airflow controller 100.

The airflow controller 100 may include a first housing 110 and a second housing 120. In addition, disposed between the first housing 110 and the second housing 120 of the airflow controller 100 may be the guide member 200 that changes the direction of the discharge airflow and a rotating member 300 that rotates to guide the movement of the guide member 200. In addition, the airflow controller 100 may include a driving part 400 that generates a rotational force to drive the rotating member 300.

The first housing 110 and the second housing 120 each include a form of an annular shape and may be detachably coupled to each other for assembly of the guide member 200 and the rotating member 300 disposed at an inside of the first housing 110 and the second housing 120, but the first housing 110 and the second housing 120 may form a unitary body.

An outer circumferential surface 111 of the first housing 110 and an outer circumferential surface 121 of the second housing 120 may each be formed as a curved surface corresponding to that of the first discharge wall 51. Accordingly, the outer circumferential surface 111 of the first housing 110 and the outer circumferential surface 121 of the second housing 120 may form the first discharge wall 51 as a part of the first discharge wall 51, or may form the discharge path 50 together with the first discharge wall 51 at the lower portion of the first discharge wall 51.

An opening is formed between the outer circumferential surface 111 of the first housing 110 and the outer circumferential surface 121 of the second housing 120, and the guide member 200 may reciprocate between the first location A and the second location B through the opening.

The first housing 110 may include an auxiliary guide 112 that guides the guide member 200 to reciprocate between the first location A and the second location B. The auxiliary guide 112 may guide the guide member 200 so that the guide member 200 is translated from the first location A to the second location B. This will be described below in detail.

The driving part 400 may generate a rotational force by the driving motor 410 and accordingly rotate the rotating member 300. The driving part 400 may be disposed at a side of the inner circumferential surfaces of the first housing 110 and the second housing 120, but the disposition of the driving part 400 is not limited thereto and the driving part 400 may be disposed on a upper portion of the upper housing 100 or may be disposed at a side of the outer circumferential surface 111 of the first housing 110 or at a side of the outer circumferential surface 121 of the second housing 120. In this case, the driving part 400 may be positioned so as not to restrict the movement of the guide member 200.

The driving part 400 may include a first gear portion 420 transmitting the rotational force generated by the driving motor 410 to the rotating member 300.

The rotating member 300 may be disposed at the upper side of the second housing 120 and provided to rotate in one direction and the opposite direction by the driving part 400.

The rotating member 300 may be formed in an annular shape. The rotating member 300 may include an outer peripheral portion 301 and an inner peripheral portion 302. In addition, the rotating member 300 may include a second gear portion 303 arranged on the inner periphery portion 302 and receiving the rotational force generated by the driving part 400. The second gear portion 303 is meshed with the first gear portion 420 so that the rotating member 300 may be rotated.

The rotating member 300 may include guide rails 310, 320, and 330 disposed on the upper surface of the rotating member 300 and guiding the movement of the guide member 200 and a rotating protrusion (not shown) disposed on the lower surface of the rotating member 300 and guiding rotation of the rotating member 300.

The rotating protrusion (not shown) may be protruded downward from the lower surface of the rotating member 300 and inserted into a guide groove 122 provided in the second housing 120. The guide groove 122 may be provided to extend a predetermined distance in a direction corresponding to the circumferential direction of the rotating member 300, and when the rotating protrusion (not shown) moves along the guide groove 122 and thus the rotating member 300 is rotated, may prevent the rotating member 300 from being separated from the second housing 120 and allow the rotating member 300 to be smoothly rotated in one direction or the opposite direction.

The guide member 200 may be disposed on the upper surface of the rotating member 300. The guide member 200 may be reciprocated between the first location A and the second location B by being interlocked with rotation in one direction or the opposite direction of the rotating member 300.

The guide member 200 may include a first guide member 210, a second guide member 220, and a third guide member 230. However, the disclosure is not limited thereto, and the guide member 200 may be provided as a single guide member, or the number of the guide members 200 may be provided greater than or less than three.

The first guide member 210, the second guide member 220, and the third guide member 230 may be respectively disposed along the circumferential direction of the rotating member 300.

The guide rails 310, 320, and 330 may include the first guide rail 310 for moving the first guide member 210, the second guide rail 320 for moving the second guide member 220, and the third guide rail 330 for moving the third guide member 230. The guide rails 310, 320 and 330 are not limited thereto, and may be provided corresponding in number to the number of the guide members 200. The respective guide rails 310, 320, and 330 may be provided in the form of a slot on the upper surface of the rotating member 300.

The first guide member 210 includes a first guide protrusion 211 inserted into the first guide rail 310, the second guide member 220 includes a second guide protrusion 221 inserted into the second guide rail 320, and the third guide member 230 includes a third guide protrusion 231 inserted into the third guide rail 330.

Each of the guide protrusions 211, 221, and 231 is provided in a symmetrical pair, and each of the guide rails 310, 320, and 330 is also provided in a symmetrical pair to correspond to each of the guide protrusions 211, 221, and 231. However, the disclosure is not limited thereto, and each of the guide protrusions 211, 221, and 231 may be provided as one guide protrusion, and each of the guide rails 310, 320, and 330 may also be provided as one guide rail correspondingly thereto. In addition, the number of guide protrusions 211, 221, and 231 and the number of guide rails 310, 320, and 330 may be provided greater than or less than three. Hereinafter, for the sake of convenience in description, the following description will be made in relation to one side of each of the pairs of guide protrusions 211, 221, and 231 and one side of each of the pairs of guide rails 310, 320, and 330.

The guide protrusions 211,221, and 231 are inserted into the guide rails 310, 320, and 330, respectively, and when the rotating member 300 is rotated in one direction or the opposite direction, are pressed against the guide rails 310, 320, and 330 inside of the guide rails 310,320, and 330, respectively, so that the respective guide members 210, 220, and 230 may reciprocate between the first location A and the second location B.

The rotating member 300 is rotated with the guide protrusions 211, 221, and 231 inserted into the guide rails 310, 320, and 330, respectively, and the respective guide rails 310, 320, and 330 are rotated in one direction or the opposite direction together with the rotating member 300, so that the guide protrusions 211, 221, and 231 inserted into the guide rails 310, 320, and 330 are pressed in the direction in which the guide rails 310, 320, and 330 are rotated, to be moved, which causes the respective guide members 210, 220, and 230 to be moved.

Figure 7A:
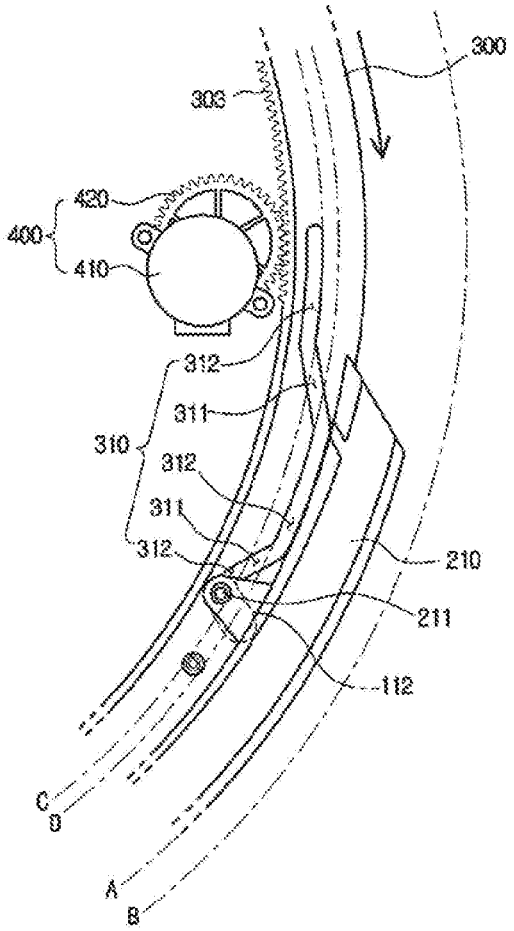
FIGS. 7A to 7C are enlarged views illustrating parts of the airflow controller of the air conditioner according to the embodiment of the disclosure.

In detail, as shown in FIG. 7A, the upper surface of the rotating member 300 may be divided into a first area C formed in a circumferential direction of the rotating member 300 and a second area D formed on a radial outer side of the first area C on the rotating member 300.

The first guide rail 310 may extend to cross the first area C and the second area D at least two times, and accordingly, the first guide protrusion 211 may be disposed on the first area C or the second area D by rotation of the first guide rail 310.

When the first guide protrusion 211 is disposed on the first area C, the first guide member 210 may be disposed at the first location A. Thereafter, when the first guide protrusion 211 pressed by the first guide rail 310 is disposed on the second area D, the first guide member 210 is disposed at the second location B. Since the second area D is disposed on the radial outer side of the first area C on the rotating member 300, the first guide member 210 may be moved to a side of the second discharge wall 53 by being interlocked with the first guide protrusion 211.

As one end of the first guide rail 310 is disposed in the first area C, the first guide protrusion 211 is also disposed in the first area C, and thus the first guide member 210 is disposed at the first location A.

Figure 7B:
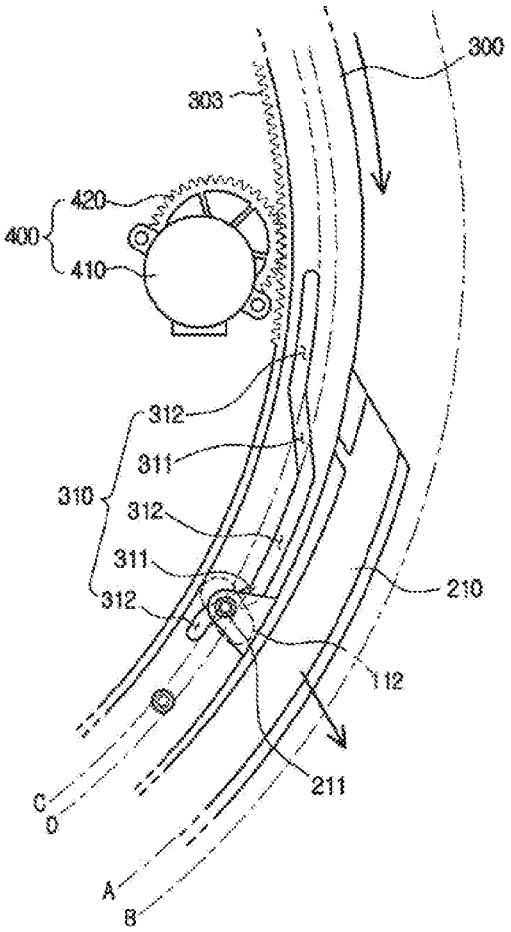

As shown in FIG. 7B, the first guide rail 310 includes a moving area 311 extending in a diagonal direction from the first area C to the second area D or from the second area D to the first area C with respect to the circumferential direction of the rotating member 300 and a through-area extending along a direction corresponding to the circumferential direction of the rotating member 300.

The first guide rail 310 may extend along the circumferential direction of the rotating member 300 so that the moving area 311 and the through-area 312 are alternately formed.

The first guide protrusion 211 disposed in the first area C is caused to be disposed inside of the moving area 311 by one direction rotation of the first guide rail 310 according to a rotation of the rotating member 300, and in this case, the first guide protrusion 211 in the moving area 311 may be pressed in a diagonal direction with respect to the circumferential direction of the rotating member 300 by the rotation of the first guide rail 310. Therefore, the first guide protrusion 211 having been disposed in the first area C is pressed against the moving area 311 to be moved to the second area D.

In this case, the auxiliary guide 112 provided in the first housing 110 may guide the first guide protrusion 211 to move from the first area C to the second area D.

As described above, as the first guide protrusion 211 is pressed in a diagonal direction by the first guide rail 310, the first guide protrusion 211 may have difficulty in translating from the first area C to the second area D. To prevent such a difficulty, the auxiliary guide 112 may guide the first guide protrusion 211 such that the first guide protrusion 211 may move in a straightforward fashion.

In detail, the auxiliary guide 112 may include a form of a slit shape formed in a radial direction of the rotating member 300. The first guide protrusion 211 is formed to protrude to a side of the first guide rail 310 as described above, but may also protrude to the opposite side of the first guide rail 310. That is, the first guide rail 310 may protrude to both sides of the first guide member 200.

The first guide protrusion 211 protruding to the opposite side of the first guide rail 310 may be inserted into the auxiliary guide 112 and moved along the slit shape of the auxiliary guide 112.

As described above, since the auxiliary guide 112 has a slit shape including a straight line in a radial direction of the rotating member 300, the first guide protrusion 211 may be linearly moved from the first area C to the second area D by the auxiliary guide 112. Conversely, when the first guide protrusion 211 is moved from the second area D to the first area C, the first guide protrusion 211 may be linearly moved along the auxiliary guide 112.

Accordingly, the first guide protrusion 211 may be pressed by the first guide rail 310 and moved from the first area C to the second area D along the auxiliary guide 112, so that the first guide member 200 may be moved from the first location A to the second location B.

However, the disclosure is not limited thereto, and the first guide member 200 may include an auxiliary protrusion inserted into the auxiliary guide 112 in addition to the first guide protrusion 211. In this case, the first guide protrusion 211 may be protruded only to one side from the first guide member 200, and the auxiliary protrusion may be protruded to the opposite side. Accordingly, when the first guide member 200 is moved due to the first guide protrusion 211, the first guide member 200 is linearly moved from the first location A to the second location B along the auxiliary guide 112.

Also, the auxiliary guide 112 may be disposed in the second housing 120 rather than in the first housing 110. In this case, the first guide protrusion 211 may be inserted into the auxiliary guide 112 by passing through the first guide rail 310, and the first guide rail 310 may include a hollow through which the first guide protrusion 211 passes.

Figure 7C:
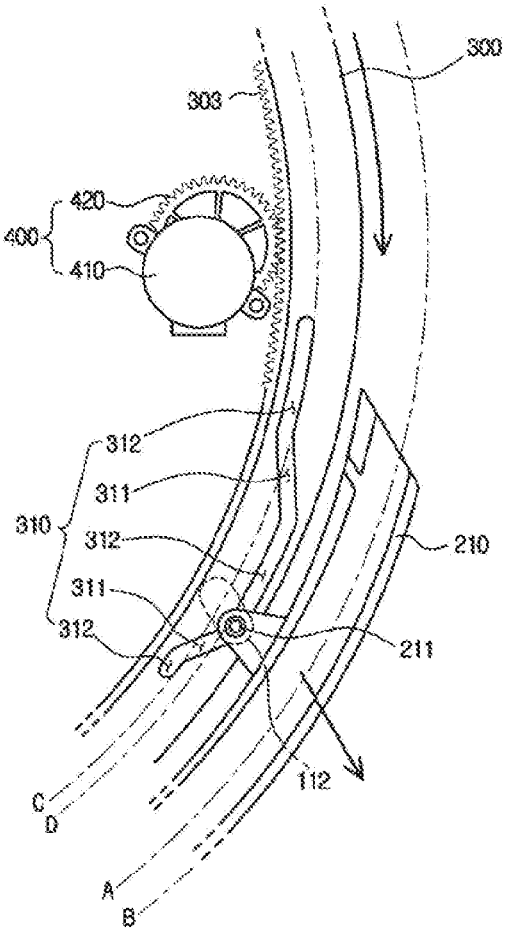

As shown in FIG. 7C, the first guide protrusion 211 disposed in the second area D by the moving area 311 may be moved along the first guide rail 310 by an additional rotation of the rotating member 300 in the one direction so as to be disposed in the through-area 312 through-area extending from the moving area 311. As described above, the through-area 312 extends in a direction corresponding to the circumferential direction of the rotating member 300, so that the first guide rail 310 may rotate by passing the first guide protrusion 211 without pressing the first guide protrusion 211.

As such, since the first guide rail 310 is rotated without pressing the first guide protrusion 211, the first guide protrusion 211 is continuously positioned on the second area D, so that the first guide member 210 may be disposed at the second location B.

Thereafter, although not shown in the drawings, while the rotating member 300 is additionally rotated in the one direction, the first guide protrusion 211 is caused to be disposed again in the moving area 312 extending from the through-area 312 and thus moved from the second area D to the first area C again. In this case, the first guide protrusion 211 may be moved in a straightforward fashion from the second area D to the first area C through the auxiliary guide 112. Therefore, the first guide member 200 may be moved in a straightforward fashion from the second location B to the first location A. In this way, the first guide member 200 may be reciprocated from the first location A to the second location B and reversely from the second location B to the first location A.

After the first guide protrusion 211 is moved to the first area C, when the rotating member 300 is additionally rotated in the one direction, the first guide protrusion 211 is caused to be disposed in the through-area extending from the moving area 312 again, so that the first guide protrusion 211 is continuously positioned on the first area C.

The rotating member 300 may be continuously rotated in the one direction until the other end of the first guide rail 310 comes into contact with the first guide protrusion 211. Thereafter, when the other end of the first guide rail 310 comes into contact with the first guide protrusion 211, the rotating member 300 may be rotated in the opposite direction, and the rotation of the rotating member 300 in the opposite direction may be performed until the first guide protrusion 211 comes into contact with the one end of the first guide rail 310.

As the rotating member 300 is rotated in the opposite direction, the first guide protrusion 211 may move between the first area C and the second area D as opposed to the description above. The principle of the movement of the first guide protrusion 211 is the same as the above except that the rotating member 300 is rotated in the opposite direction, and thus detailed description thereof will be omitted.

In addition, the principle that the second guide protrusion 221 inserted into the second guide rail 320 and the third guide protrusion 231 inserted into the third guide rail 330 are moved is also the same as that of the first guide protrusion 211 inserted in the first guide rail 310 described above, and thus detailed description thereof will be omitted.

Hereinafter, features associated with movement of each guide member 200 will be described in detail. FIGS. 8 to 13 are views illustrating the guide member moved by the rotating member of the air conditioner according to the embodiment of the disclosure.

As described above, each guide member 200 may be provided to reciprocate between the first location A and the second location B by rotation of a corresponding one of the guide rails 310, 320, and 330.

However, when the guide members 200 are simultaneously disposed in the first location A or in the second location B, there is limitation in airflow control of the air conditioner 1.

The air conditioner 1 according to the embodiment of the disclosure may discharge air in all directions of 360 degrees of the air conditioner 1 as the air conditioner 1 has the discharge port 56 in an annular shape. In this case, depending on occasions, a downward airflow may be required in some areas of the 360-degree directions, and a wide airflow may be required in some other areas, but the guide members 200 simultaneously reciprocated between the first location A and the second location B in the same manner may have difficulty in satisfying the user with the airflow control in such a situation.

In order to prevent such a limitation, the airflow controller 100 of the air conditioner 1 according to the embodiment of the disclosure may allow the guide members 200 to be each disposed at a different position between the first location A and the second location B, as well as allowing the guide members 200 to be simultaneously reciprocated between the first location A and the second location B.

Unlike the embodiment of the disclosure, when the airflow controller includes a driving part that independently drives each guide member 200, that is, when the airflow controller 100 includes a first driving part for driving the first guide member 210, a second driving part for driving the second guide member 220, and a third driving part for driving the third guide member 230, the airflow controller 100 may easily control each of the guide members 200 to be disposed at a different position between the first location A and the second location B.

However, in this case, as the number of the driving parts is increased, the rotating member 300 connecting the driving part to the guide member 200 is additionally increased, and thus the configuration assembled inside the air conditioner 1 is increased, which may increase the volume of the air conditioner 1 and the manufacturing cost.

In order to prevent such a limitation, the airflow controller 100 according to the embodiment of the disclosure may move each of the guide members 200 to be disposed at a different position through a single driving part 400 and a single rotating member 300.

In detail, during one round of a reciprocating rotation in which the rotating member 300 rotates a predetermined angle in one direction and then rotates a predetermined angle in the opposite direction, the airflow controller 100 may allow each of the guide members 200 to be disposed at the first location A when the rotating member 300 rotates a first angle from a start position of the rotation, allow each of the guide members 200 to be disposed at the second location B when the rotating member 300 rotates a second angle from the start position, and allow at least one of the guide members 200 to be disposed at the first location A and the remaining to be disposed at the second location B when the rotating member 300 rotates a third angle from the start position, That is, while the rotating member 300 reciprocatingly rotates one round, the airflow controller 100 allows each of the guide members 200 to be disposed at one of the first location A and the second location B according to the angle rotated by the rotating member 300.

In this case, when the first guide member 210, the second guide member 220, and the third guide member 230 are each disposed in one of the first location A and the second location B, the arrangement of all the guide members 200 is referred to as a position p, the number of occurrences for the position p is $8(2^3)$ in total as the airflow controller 100 includes the three guide members 210, 220, and 230.

Accordingly, the airflow controller 100 may move each guide member 210, 220, and 230 such that the three guide members 210, 220, and 230 are disposed with eight positions p while the rotating member 300 reciprocatingly rotates one round.

The disclosure is not limited thereto, and when the guide members 200 are provided as n guides members, the airflow controller 100 may move the n guide members 200 such that a total number of $2^n$ positions occurs during one round of reciprocating rotation of the rotating member 300.

In order to generate various positions p, the respective guide rails 310, 320, and 330 may extend along the circumferential direction of the rotating member 300 while passing through the first area C and the second area D in different forms.

Figure 8:
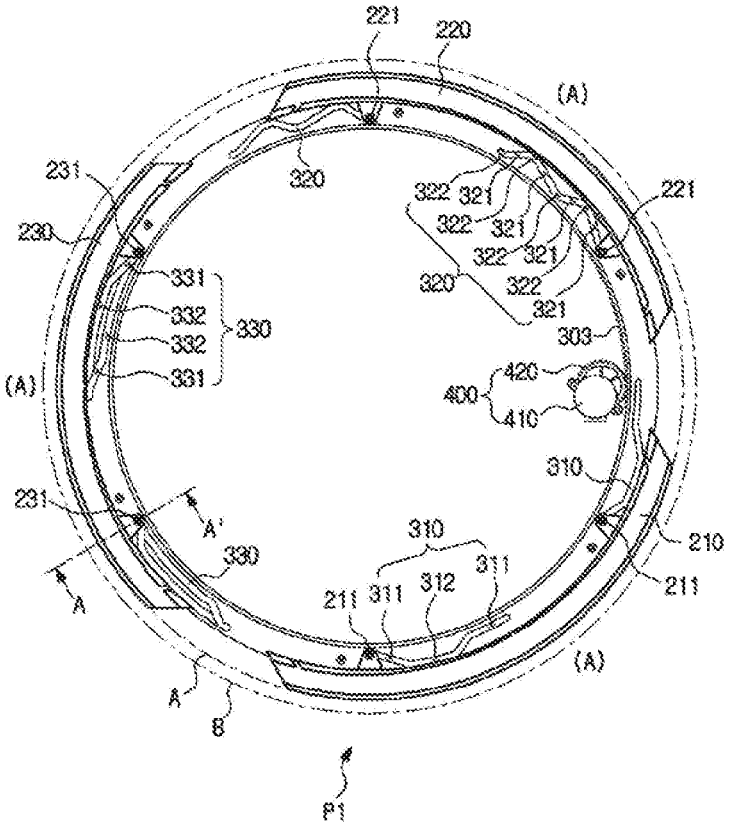
FIGS. 8 to 15 are views illustrating a guide member moved by a rotating member of the air conditioner according to an embodiment of the disclosure.

As shown in FIG. 8, the first guide rail 310, the second guide rail 320, and the third guide rail 330 may be formed in different forms.

The first guide rail 310 may be provided with two moving areas 311 and three through-areas 312. That is, the first guide rail 310 allows the first guide member 210 to be reciprocated between the first location A and the second location B a total of two times while the rotating member 300 reciprocatingly rotates one round.

The second guide rail 320 may be provided with four moving areas 321 and five through-areas 322. That is, the second guide rail 320 allows the second guide member 220 to be reciprocated between the first location A and the second location B a total of four times while the rotating member 300 reciprocatingly rotates one round.

The third guide rail 330 may be provided with two moving areas 331 and two through-areas 332. That is, the third guide rail 330 allows the third guide member 230 to be reciprocated between the first location A and the second location B a total of one time while the rotating member 300 reciprocatingly rotates one round.

As the shapes of the respective guide rails 310, 320, and 330 are differently formed as described above, the airflow controller 100 may adjust the number of times each guide member 210, 220, and 230 is reciprocated and the reciprocating timing of each guide member 210, 220, and 230. Therefore, the shapes of the guide rails 310, 320, and 330 of the airflow controller 100 may be adjusted such that all the cases for positions p occur while the rotating member 300 reciprocatingly rotates one round. As described above, the number and shapes of the guide rails may be set differently according to the number of the guide members 200 included in the airflow controller 100.

The airflow controller 100 according to the embodiment of the disclosure includes three guide members 210, 220 and 230 and may include at least three guide rails 310, 320 and 330 to correspond to the three guide members 210, 220 and 230. Each of the guide rails 310, 320, and 330 may be provided in a pair of guide rails to correspond to each of the guide member 210, 220, and 230. Therefore, the airflow controller 100 may include a total of six guide rails 310,320, and 330. However, the disclosure is not limited thereto, and a single guide rail 310, 320, or 330 may be provided for each of the guide members 210, 220, and 230. Hereinafter, for the sake of convenience in description, the following description will be made in relation to only one side of each of the pairs of guide rails 310, 320, and 330

At least one guide rail 330 among the three guide rails 310, 320, and 330 may be provided in a closed loop shape. That is, the third guide rail 330 is provided in a closed loop shape, and the first guide rail 310 and the second guide rail 320 may extend along the circumferential direction of the rotating member 300 so as to each have one end and the other end.

Since the length of the circumference of the rotating member 300 is limited, when all the three guide rails 310, 320 and 330 extend along the circumferential direction of the rotating member 300, the sum of extension lengths of the respective guide rails 310, 320, and 330 along the set rotating member 300 may need to be longer than the circumferential length of the rotating member 300.

In this case, the rotating member 300 needs to have a larger circumferential length, which may cause the volume of the air conditioner 1 to be increased.

Therefore, when the airflow controller 100 includes a plurality of guide rails 310, 320 and 330, at least one guide rail 330 is provided in a closed loop shape, so that the total length of extension of the at least one guide rail 330 in the circumference direction of the rotating member 300 may be shortened. However, the disclosure is not limited thereto, and the first guide rail 310 or the second guide rail 320 may be additionally formed in a closed loop shape, and when the sum of the total extension lengths of the three guide rails 310, 320, and 330 is shorter than the circumferential length of the rotating member 300, the third guide rail 300 may also extend in the circumferential direction of the rotating member 300 to including one end and the other end thereof rather than having a closed loop form, unlike the embodiment of the disclosure.

Hereinafter, the arrangement of the respective guide rail 310, 320, and 330 in each position p will be described in detail.

As shown in FIG. 8, when the rotating member 300 is disposed at the starting position before rotation, the first guide protrusion 211 is disposed at one end of the first guide rail 310 and the second guide protrusion 221 is disposed at one end of the second guide rail 320, and the third guide protrusion 231 is disposed at one end of the third guide rail 330.

The one end of the first guide rail 310, the one end of the second guide rail 320, and the one end of the third guide rail 330 may be all disposed in the first area C such that each of the guide members 200 is disposed at the first location A (see FIG. 7A).

As such, when all the three guide members 210, 220, and 230 are disposed at the first location A and the rotating member 300 is at the starting point, the position p of the guide members 210, 220, and 230 is defined as a first position p1.

Figure 9:
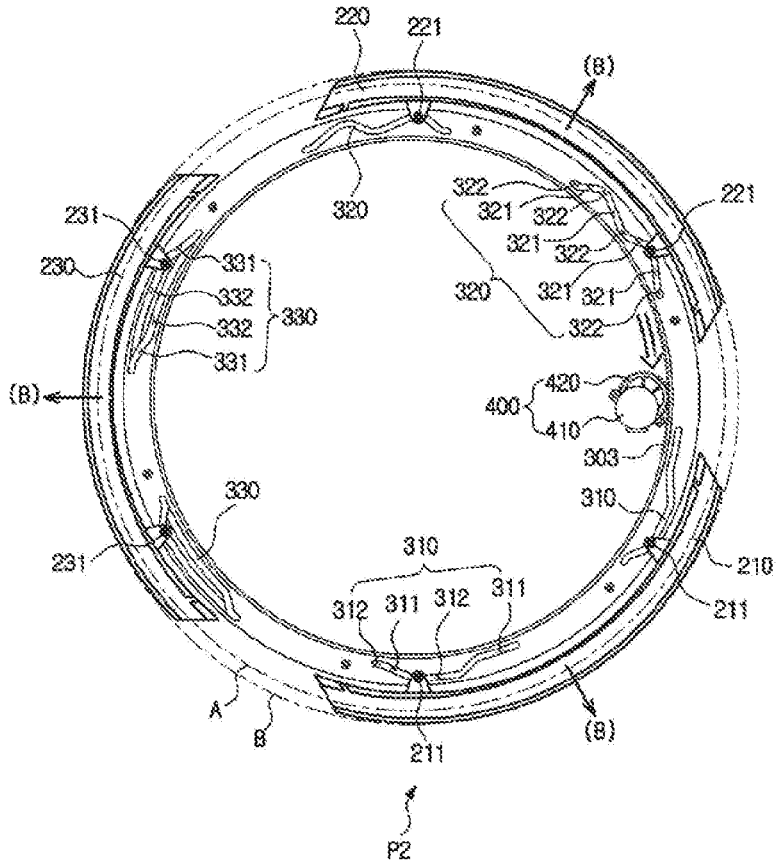

As shown in FIG. 9, when the rotating member is rotated at a predetermined angle in one direction in the first position p1, the first guide protrusion 211 is caused to be disposed in the second area D by the moving area 311 of the first guide rail 310 (see FIG. 7C), and the second guide protrusion 221 is caused to be disposed in the second area D by the moving area 321 of the second guide rail 320, and the three guide protrusion 231 is caused to be disposed in the second area D by the moving area 331 of the third guide rail 330.

Accordingly, all the three guide members 210, 220, and 230 are disposed at the second location B, and in this case, the position p of the three guide members 210, 220, and 230 may be defined as a ∟ 2.

Figure 10:
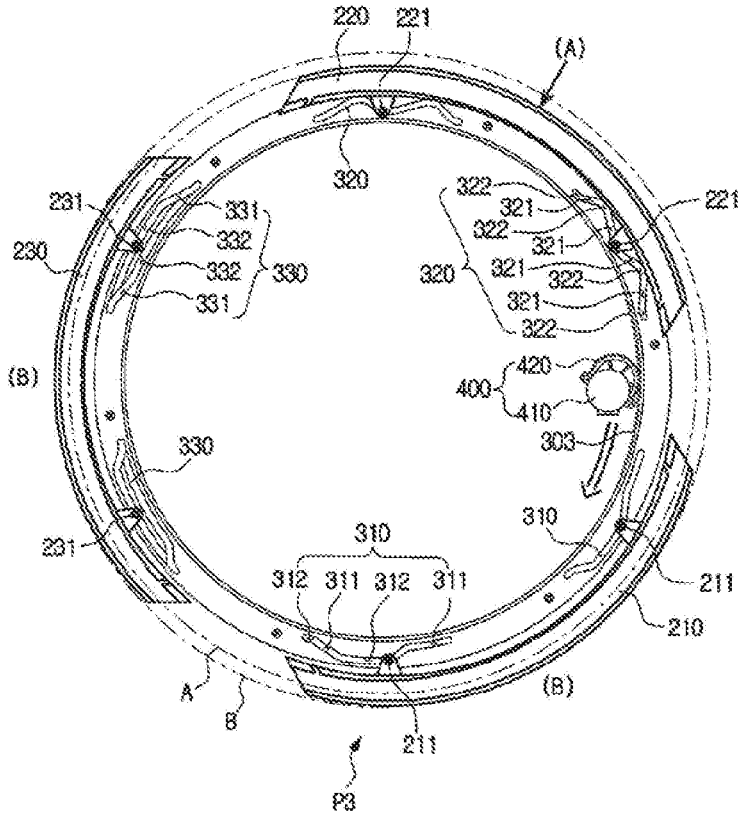

As shown in FIG. 10, when the rotating member is further rotated at a predetermined angle in the one direction in the second position p2, the first guide protrusion 211 is kept disposed in the second area D by the through-area 312 of the first guide rail 310, the second guide protrusion 221 is moved by the moving area 321 of the second guide rail 320 to the first area C, and the third guide protrusion 231 is kept disposed in the second area D by the through-area 332 of the third guide rail 330.

Accordingly, among the three guide members 210, 220, and 230, the first guide member 210 and the third guide member 230 are disposed at the second location B, and the second guide member 220 is disposed at the first location A. In this case, the position p of the three guide members 210, 220, and 230 may be defined as a third position p3.

Figure 11:
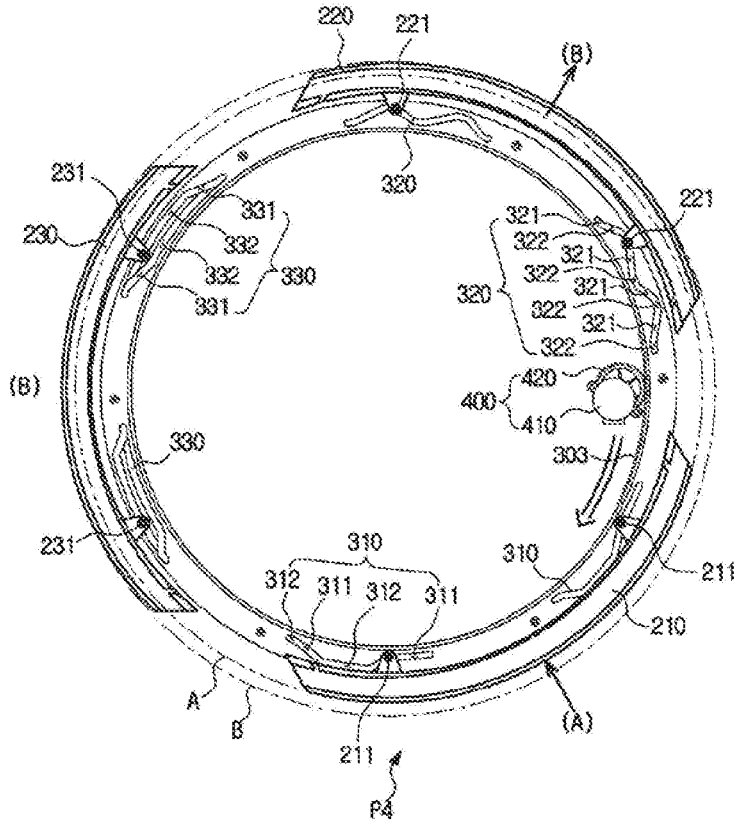

As shown in FIG. 11, when the rotating member is further rotated at a predetermined angle in the one direction in the third position p3, the first guide protrusion 211 is moved by the moving area 311 of the first guide rail 310 to the first area C, the second guide protrusion 221 is moved by the moving area 321 of the second guide rail 320 back to the second area D, and the third guide protrusion 231 is kept disposed in the second area D by the through-area 332 of the third guide rail 330.

Accordingly, among the three guide members 210, 220, and 230, the second guide member 220 and the third guide member 230 are disposed at the second location B, and the first guide member 210 is disposed at the first location A. In this case, the position p of the three guide members 210, 220, and 230 may be defined as a fourth position p4.

Figure 12:
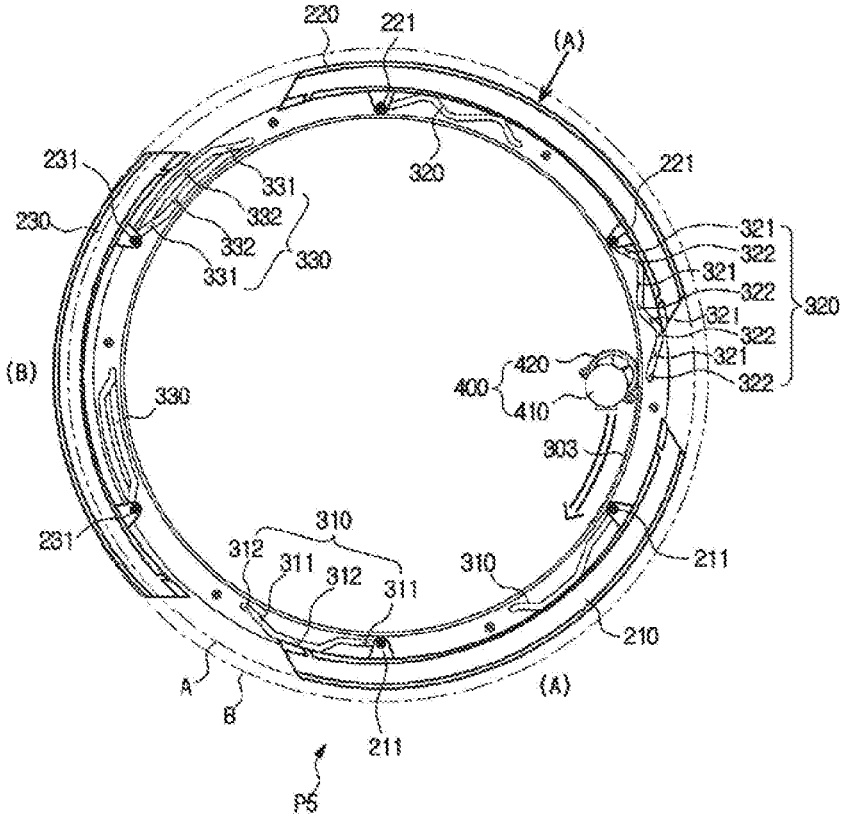

As shown in FIG. 12, when the rotating member is further rotated at a predetermined angle in the one direction in the fourth position p4, the first guide protrusion 211 is kept disposed in the first area C by the through-area 312 of the first guide rail 310, the second guide protrusion 221 is moved by the moving area 321 of the second guide rail 320 back to the first area C, and the third guide protrusion 231 is kept disposed in the second area D by the through-area 332 of the third guide rail 330.

Accordingly, among the three guide members 210, 220, and 230, the third guide member 230 is disposed at the second location B, and the first guide member 210 and the second guide member 220 are disposed at the first location A. In this case, the position p of the three guide members 210, 220, and 230 may be defined as a fifth position p5.

In the fifth position p5, the first guide protrusion 211 is disposed on the other end of the first guide rail 310, the second guide protrusion 221 is disposed on the other end of the second guide rail 320, and the third guide protrusion 231 is disposed on the other end of the third guide rail 330. As each of the guide protrusions 211, 221, and 231 is disposed at the other end of a corresponding one of the guide rails 310, 320, and 330, the rotating member 300 may no longer rotate in the one direction, and rotation in the one direction is stopped.

That is, the rotating member 300 may be set to rotate in one direction from a point in time when each of the guide protrusions 211, 221, and 231 is disposed at one end of a corresponding one of the guide rails 310, 320, and 330 to a point in time when each of the guide protrusions 211, 221, and 231 is disposed at the other end of the corresponding one of the guide rails 310, 320, and 330. When each of the guide protrusions 211, 221, and 231 is disposed at the other end of the corresponding one of the guide rails 310, 320, and 330, the rotating member 300 is rotated in the opposite direction such that the rotating member 300 performs one round of reciprocating rotation.

Figure 13:
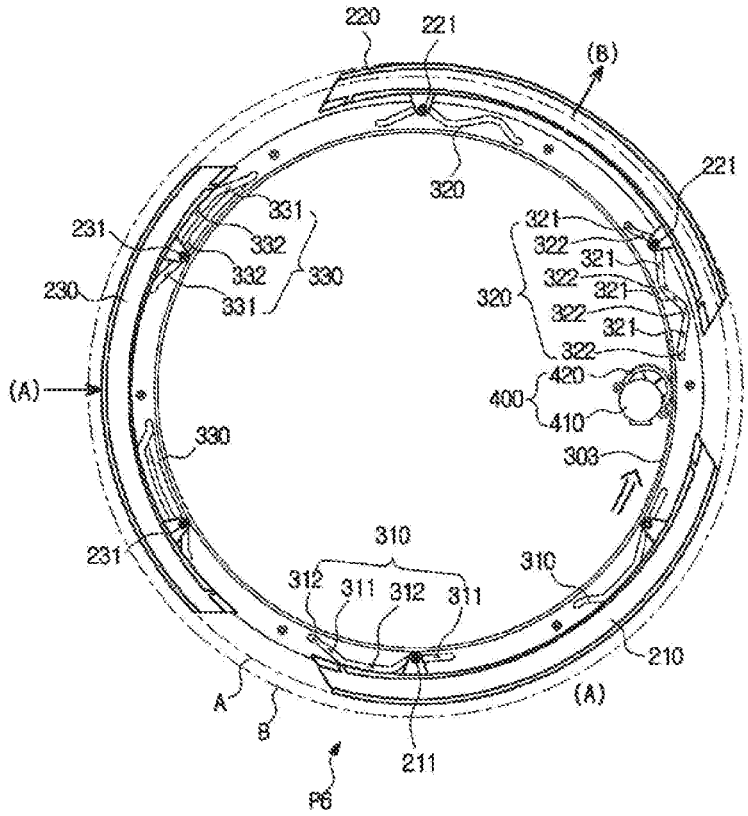

As shown in FIG. 13, when the rotating member is rotated at a predetermined angle in the opposite direction in the fifth position p5, the first guide protrusion 211 is kept disposed in the first area C by the through-area 312 of the first guide rail 310, the second guide protrusion 221 is moved by the moving area 321 of the second guide rail 320 back to the second area D, and the third guide protrusion 231 is moved by the moving area 331 of the third guide rail 330 to the first area C.

Accordingly, among the three guide members 210, 220, and 230, the first guide member 210 and the third guide member 230 are disposed at the first location A, and the second guide member 220 is disposed at the second location B. In this case, the position p of the three guide members 210, 220, and 230 may be defined as a sixth position p6.

Figure 14:
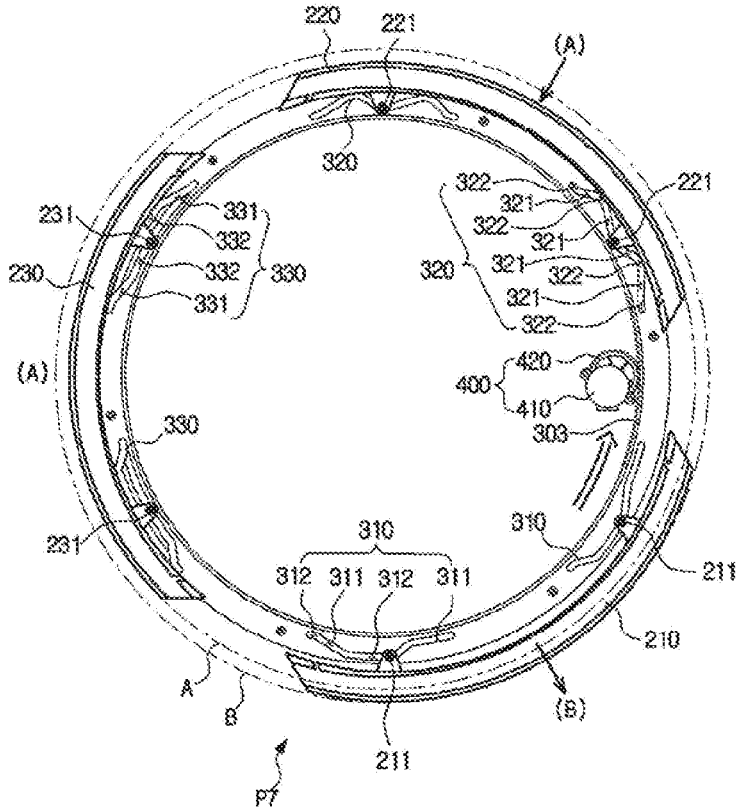

As shown in FIG. 14, when the rotating member is further rotated at a predetermined angle in the opposite direction in the sixth position p6, the first guide protrusion 211 is moved by the moving area 311 of the first guide rail 310 to the first area D, the second guide protrusion 221 is moved by the moving area 321 of the second guide rail 320 back to the first area C, and the third guide protrusion 231 is kept disposed in the first area C by the through-area 332 of the third guide rail 330.

Accordingly, among the three guide members 210, 220, and 230, the second guide member 220 and the third guide member 230 are disposed at the first location A, and the first guide member 210 is disposed at the second location B. In this case, the position p of the three guide members 210, 220, and 230 may be defined as a seventh position p7.

Figure 15:
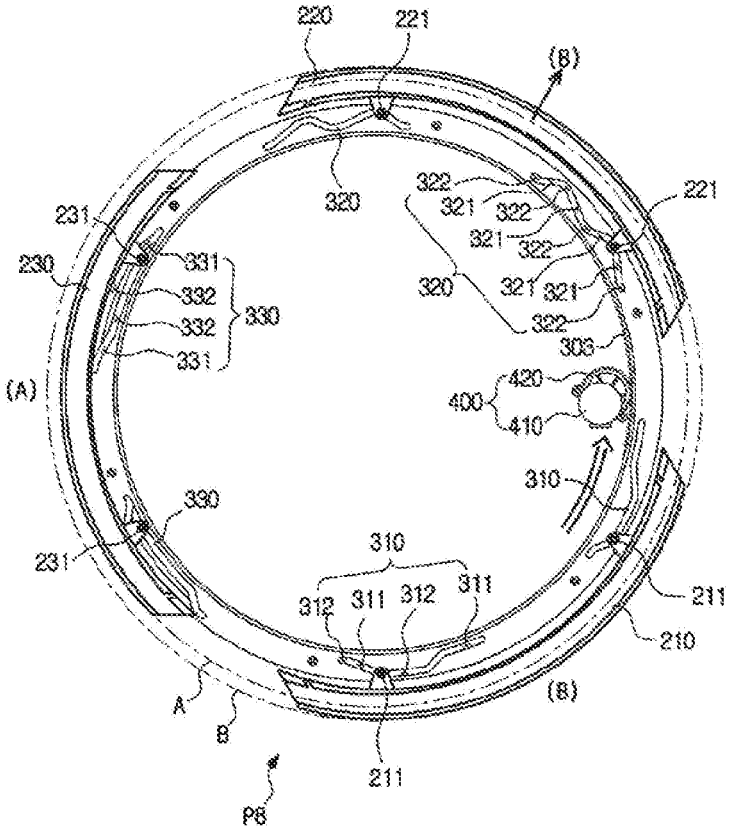

As shown in FIG. 15, when the rotating member is further rotated at a predetermined angle in the opposite direction in the seventh position p7, the first guide protrusion 211 is kept disposed in the first area D by the through-area 312 of the first guide rail 310, the second guide protrusion 221 is moved by the moving area 321 of the second guide rail 320 back to the second area D, and the third guide protrusion 231 is kept disposed in the first area C by the through-area 332 of the third guide rail 330.

Accordingly, among the three guide members 210, 220, and 230, the third guide member 230 is disposed at the first location A, and the first guide member 210 and the second guide member 220 are disposed at the second location B. In this case, the position p of the three guide members 210, 220, and 230 may be defined as an eighth position p8.

When the rotating member is rotated a predetermined angle in the opposite direction in the eighth position p8, the rotating member 300 completes one round of the reciprocating rotation, and each of the guide protrusion 211, 221, and 231 returns to the minimum starting point, so that the guide members 210, 220, and 230 may be disposed in the first position p1.

As described above, each of the guide members 210, 220, and 230 may be disposed in the forms of a total of eight positions p, which is the maximum number of cases, during one round of reciprocating rotation of the rotating member 300. Accordingly, the user may easily adjust the discharge airflow of the air conditioner 1 in all directions.

Hereinafter, the third guide rail 330 formed in a closed loop shape among the plurality of guide rails 310, 320, and 330 will be described in detail.

Figure 16:
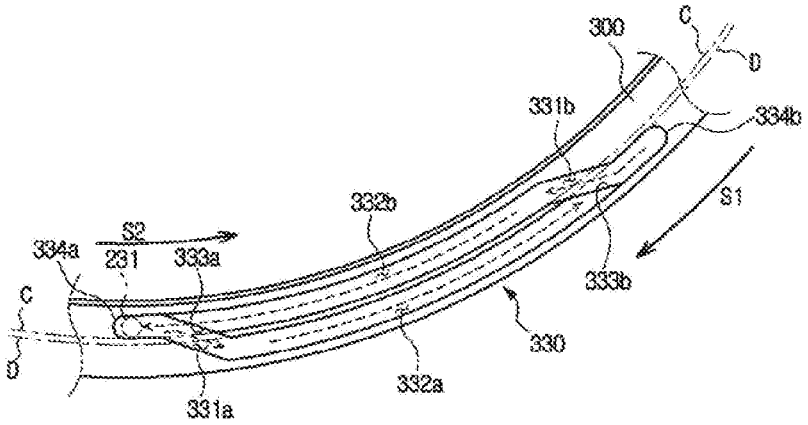
FIG. 16 is a cross-sectional view taken line along A-A' disclosed in FIG. 8.
Figure 17:
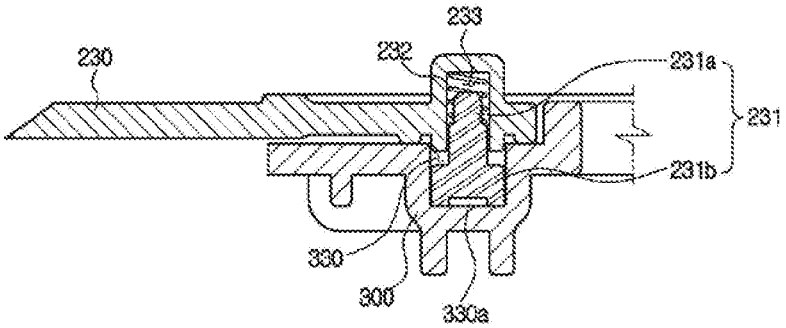
FIG. 17 is a view illustrating a part of the rotating member of the air conditioner according to the embodiment of the disclosure.
Figure 18:
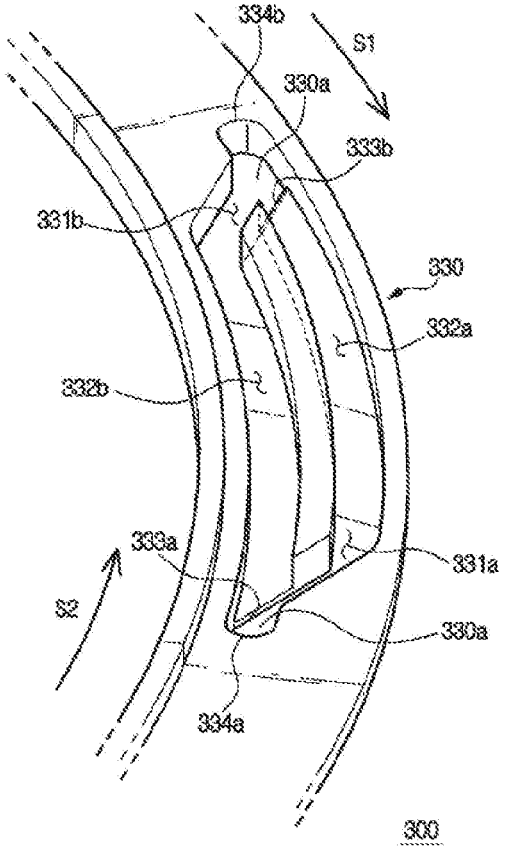
FIG. 18 is a perspective view illustrating a part of the rotating member of the air conditioner according to the embodiment of the disclosure.

FIG. 16 is a cross-sectional view taken line along A-A' disclosed in FIG. 8, FIG. 17 is a view illustrating a part of the rotating member of the air conditioner according to the embodiment of the disclosure, and FIG. 18 is a perspective view illustrating a part of the rotating member of the air conditioner according to the embodiment of the disclosure.

Since the length of the circumference of the rotating member 300 is limited as described above, when all the three guide rails 310, 320, and 330 extend along the circumferential direction of the rotating member 300, a length longer than the length of the circumference of the rotating member 300 may be required for the sum of extension lengths of the respective guide rails 310, 320, and 330 in the set rotating member 300, and thus the third guide rail 330 may include a closed loop shape.

In detail, as shown in FIG. 16, the first moving area 331*a* and the first through-area 322 allowing the third guide protrusion 231 to be disposed in the second area D may be connected to the second moving area 331*b* and the second through-area 332*b* allowing the third guide protrusion 231 to be disposed in the first area C. Accordingly, when the rotating member 300 is rotated in one direction (S1) with the third guide protrusion 231 inserted into one side 334*a* of the third guide rail 330, the third guide protrusion 231 is moved by the first moving area 331*a* to the second area D and is maintained in place by the first through-area 332*a*. According to subsequent rotations of the rotating member 300 in the one direction S1, the third guide protrusion 231 may be caused to be disposed on the other side 334*b* of the third guide rail 330.

Thereafter, when the rotating member 300 is rotated in the opposite direction S2, the third protrusion 231 is moved by the second moving area 331*b* back to the first area C, and then is maintained in place by the second through-area 332*b*. According to subsequent rotations of the rotating member 300 in the opposite direction S2, the third guide protrusion 231 may be caused to be disposed on the one side 334*a* of the third guide rail 330 again. Thereafter, when the rotating member 300 is rotated again in the one direction S1, the third guide protrusion 231 may be moved by the first moving area 331*a* again.

However, since the third guide rail 330 is formed in a closed loop shape as described above, when the rotating member 300 is rotated in the one direction S1, the third guide protrusion 231 once disposed on the one side 334*a* of the third guide rail 330 may not be moved by the first moving area 331*a* to the second area D, but may be kept positioned in the first area C by passing through the second through-area 332*b*.

That is, since the first moving area 331*a* of the third guide rail 330 is connected to the second through-area 322*b* of the third guide rail 330, the third guide protrusion 231 may be guided not by the first moving area 331*a* but by the second through-area 332*b* through the rotation of the rotating member 300. On the contrary, when the rotating member 300 is rotated in the opposite direction S2, the third guide protrusion 231 disposed on the other side 334*b* of the third guide rail 330 may not be guided by the second moving area 331*b* but may pass through the first through area 332*a*, and thus remain in the second area D without being moved to the first area C.

To prevent such a limitation, the third guide rail 330 includes a first ridge 333*a* that prevents the third guide protrusion 231 from being guided by the second through-area 332*b* when the third guide protrusion 231 is disposed on the one side 334*a* of the third guide rail 330 and a second ridge 333*b* that prevents the third guide protrusion 231 from being guided by the first through-area 332*a* when the third guide protrusion 333*b* is disposed on the other side 334*b* of the third guide rail 330.

In addition, as shown in FIG. 17, the third guide protrusion 231 may be supported by an elastic member 232 such that the third guide protrusion 231 is prevented by the first and second ridges 333*a* and 333*b* from being guided by the second through-area 332*b* and the first through-area 332*a*.

The third guide member 230 includes a receiving portion 233 in which the elastic member 232 is received, and the elastic member 232 may be inserted into the receiving portion 233. In addition, one side 231*a* of the third guide protrusion 231 may be inserted into the receiving portion 233 together with the elastic member 232, and the other side 231*b* of the third guide protrusion 231 may be inserted into the third guide rail 330 and guided by the third guide rail 330.

The elastic member 232 may be provided to press the third guide protrusion 231 toward the third guide rail 330 so that the third guide protrusion 231 comes into close contact with a bottom surface 330*a* of the third guide rail 330.

The third guide protrusion 231 may come in close contact with the bottom surface 330*a* of the third guide rail 330 through the elastic member 232, and accordingly, the third guide protrusion 231 is restricted by the first ridge 333*a* or the second ridge 333*b* from being guided by the second through-area 332*b* and the first through-area 332*a*.

That is, as shown in FIG. 18, the first ridge 333*a* and the second ridge 333*b* may be formed to have a height with respect to the bottom surface 330*a* of the third guide rail 330. Accordingly, due to the first ridge 333*a*, the third guide protrusion 231 is not guided by the second through-area 332, but is moved along the first moving area 331*a*. In addition, due to the second ridge 333*b*, the third guide protrusion 231 is not guided by the first through-area 331, but is moved along the second moving area 331*b*.

The bottom surface 330*a* of the third guide rail 330 provided on the first through-area 332*a* and the second through-area 322*b* may be formed to be inclined. In detail, the bottom surface 330*a* on the first through-area 332*a* may be obliquely formed to face upward as being directed from the one side 334*a* of the third guide rail 330 to the other side 334*b* of the third guide rail 330.

In addition, the bottom surface 330*a* on the second through-area 332*b* may be obliquely formed to face upward as being directed from the other side 334*b* of the third guide rail 330 to the one side 334*a* of the third guide rail 330. Accordingly, the first ridge 333*a* and the second ridge 333*b* may be formed to have a height with respect to the bottom surface 330*a* of the third guide rail 330.

Hereinafter, an airflow controller 100 of an air conditioner according to another embodiment of the disclosure will be described. Components except for a rotating member 300' described below are the same as those of the airflow controller 100 of the air conditioner according to the previous embodiment of the disclosure, and thus details thereof will be omitted. In addition, the rotating member 300' according to the embodiment of the disclosure may include a plurality of guide rails 310'. However, the following description will be made with only one of the plurality of guide rails 310' in order to omit redundancy.

Figure 19:
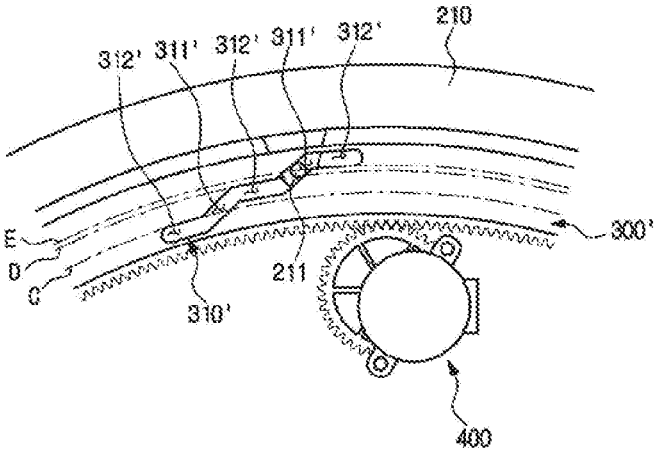
FIG. 19 is an enlarged view illustrating a part of an air conditioner according to another embodiment of the disclosure.

FIG. 19 is an enlarged view illustrating a part of the air conditioner according to the embodiment of the disclosure.

Referring to FIG. 19, an upper surface of the rotating member 300' is divided into a first area C formed in the circumferential direction of the rotating member 300', a second area D formed on a radial outer side of the first area C on the rotating member 300', and a third area E formed on a radial outer side of the second area D on the rotating member 300'.

The guide rail 310' may be extended to cross the first area C, the second area D, and the third area E at least one time, and accordingly, the guide protrusion 211 may be disposed on the first area C, the second area D, or the third region E by rotation of the guide rail 310'.

The guide member 210 when the guide protrusion 211 is disposed in the third area E may protrude toward the second discharge wall 52 by a larger length compared to when the guide member 210 is disposed in the second location B. Accordingly, unlike the previous embodiment according to the disclosure, the airflow controller 100 according to the embodiment of the disclosure may adjust the direction of the discharge airflow more delicately.

Hereinafter, an airflow controller 100' of an air conditioner according to another embodiment of the disclosure will be described. Components except for the air control unit 100' described below are the same as those of the air conditioner 1 according to the previous embodiment of the disclosure, and thus details thereof will be omitted.

Figure 20:
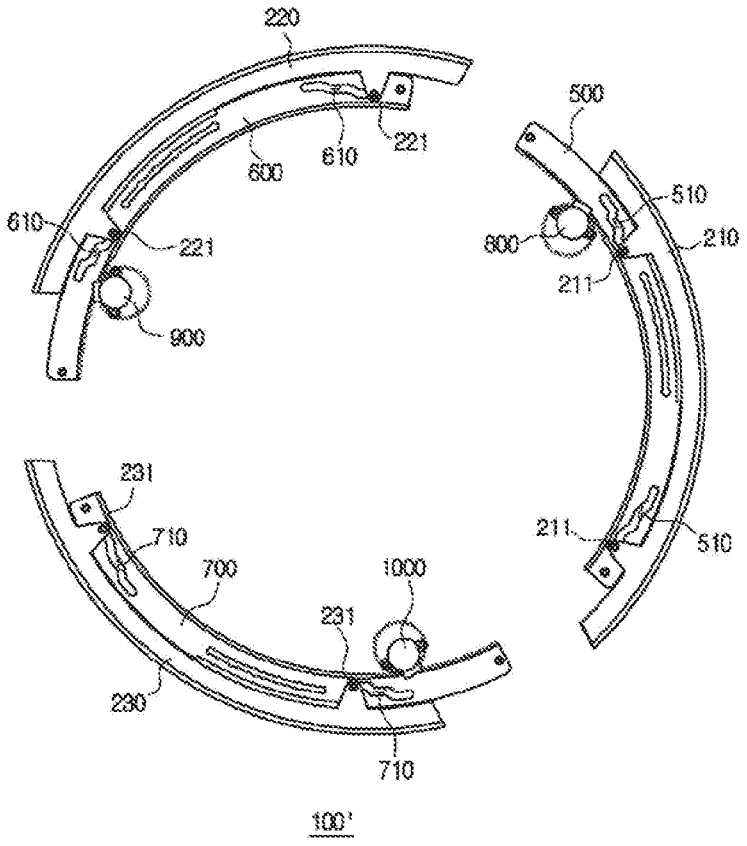
FIG. 20 is a view illustrating a part of an air conditioner according to another embodiment of the disclosure.

FIG. 20 is a view illustrating a part of the air conditioner according to the embodiment of the disclosure.

As shown in FIG. 20, the airflow controller 100' may include a first guide member 210, a second guide member 220, and a third guide member 230. In addition, the airflow controller 100' may include a first rotating member 500, a second rotating member 600, and a third rotating member 700 corresponding to the first guide member 210, the second guide member 220, and the third guide member 230, respectively. In addition, the airflow controller 100' may include a first driving part 800, a second driving part 900, and a third driving part 1000 provided to rotate the first rotating member 500, the second rotating member 600, and the third rotating member 700, respectively.

Each of the driving parts 800, 900, and 1000 may independently rotate a corresponding one of the rotating members 500, 600, and 700. As each of the rotating members 500,600, and 700 is independently rotated, each of the guide members 210,220, and 230 connected to a corresponding one of the rotating member 500,600, and 700 independently perform reciprocating motion from the first location A to the second location B and even to a position further adjacent to the second discharge wall 62 than the second location B is.

Unlike the respective guide rails 310, 320, and 330 according to the previous embodiment of the disclosure, the guide rails 510, 610, and 710 provided on the rotating members 500, 600, and 700 according to the present embodiment of the disclosure may be formed in the same shape. Since each of the rotating members 500,600, and 700 is independently rotated, even when the guide rails 510,610, and 710 are formed in the same shape, each of the guide members 210,220, and 230 may be freely disposed in a different position, that is, any one of the first location A, the second location B, or the position adjacent to the second discharge wall 52 than the second location B is.

Therefore, the first guide protrusion 211 of the first guide member 210, the second guide protrusion 221 of the second guide member 220, and the third guide protrusion 231 of the third guide member 230 may be inserted into the first guide rail 510, the second guide rail 610, and the third guide rail 710, which are formed in the same shape, and when the respective rotating members 500, 600, and 700 are rotated in one direction at the same angle, may be moved to the same position.

However, the airflow controller 100' may set the first rotating member 500, the second rotating member 600, and the third rotating member 700 such that the first rotating member 500, the second rotating member 600, and the third rotating member 700 are rotated at different angles according to control of the airflow controller 100', causing the respective guide members 210, 220, and 230 to be disposed at different positions.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

[Modes of the Disclosure]

[Industrial Applicability]

[Sequence Listing Free Text]

The invention claimed is:

1. An air conditioner comprising:

a housing including a discharge path, a first discharge wall forming the discharge path, and a second discharge wall arranged at a side opposite to the first discharge wall; and an airflow controller including a guide configured to move between a first location provided at an inside of the first discharge wall and a second location protruding outside of the first discharge wall, a driving motor configured to generate a rotary power, and a rotating member provided to be rotated by the driving motor and to move the guide between the first location and the second location, wherein the rotating member has a ring shape and includes a guide rail configured to press the guide toward the second discharge wall or press the guide toward the inside of the first discharge wall in accordance with rotation of the rotating member and extending to alternately pass through a first area on the rotating member and a second area arranged at a radial outer side of the first area on the rotating member, wherein the guide includes a guide protrusion inserted into the guide rail and moved by the guide rail, wherein the guide is disposed on the first location when the guide protrusion is disposed on the first area by the movement of the guide rail, and the guide is disposed on the second location when the guide protrusion is disposed on the second area by the movement of the guide rail, wherein the airflow controller further includes an auxiliary guide formed to extend in a radial direction of the rotating member and be coupleable with the guide protrusion so that the auxiliary guide guides a movement direction of the guide for the guide to perform a translation motion between the first location and the second location, wherein the guide includes a first guide member, a second guide member, and a third guide member arranged along a circumferential direction of the rotating member, wherein the rotating member includes a first guide rail that presses the first guide member toward the second discharge wall or presses the guide toward the inside of the first discharge wall, a second guide rail that presses the second guide member toward the second discharge wall or presses the guide toward the inside of the first discharge wall, and a third guide rail that presses the third guide member toward the second discharge wall or presses the guide toward the inside of the first discharge wall in accordance with rotation of the rotating member, wherein the first guide member includes a first guide protrusion inserted into the first guide rail and moved by the guide rail, wherein the second guide member includes a second guide protrusion inserted into the second guide rail and moved by the guide rail, wherein the third guide member includes a third guide protrusion inserted into the third guide rail and moved by the guide rail, wherein each of the first, second, and third guide rails extends to alternately pass through a first area on the rotating member and a second area arranged at a radial outer side of the first area on the rotating member, wherein each of the first, second, and third guide members is disposed on the first location when a corresponding one of the first, second, and third guide protrusions is disposed on the first area by the movement of the corresponding guide rail, wherein each of the first, second, and third guide members is disposed on the second location when a corresponding one of the first, second, and third guide protrusions is disposed on the second area by the movement of the corresponding guide rail, and wherein each of the first, second, and third guide rail are formed to have a different shape.

2. The air conditioner of claim 1, wherein the airflow controller further includes a first gear portion configured to transmit the rotary power of the driving motor to the rotating member, wherein the rotating member includes an inner circumferential portion, an outer circumferential portion, and a second gear portion arranged on the inner circumferential portion and engaged with the first gear portion, and the rotating member is provided to be rotated by engagement of the first gear portion and the second gear portion.

3. The air conditioner of claim 1, wherein the guide rail is provided to extend from a third area arranged at a radial outer side of the second area on the rotating member to the first area, wherein the guide, when the guide protrusion is disposed on the third area by the movement of the guide rail, is protruded further outward from the first discharge wall than when the guide protrusion is disposed on the second area.

4. The air conditioner of claim 1, wherein the guide rail while rotating in one direction or an opposite direction along with rotation of the rotating member presses the guide protrusion such that the guide protrusion reciprocates between the first area and the second area.

5. The air conditioner of claim 1, wherein the rotating member is provided to rotate in one direction and rotate in an opposite direction in a reciprocating manner, wherein each of the first, second, and third guide protrusions reciprocates between the first location and the second location at least one time while the rotating member performs one round of reciprocating rotation.

6. The air conditioner of claim 5, wherein when the first rotating member performs one round of reciprocating rotation, the first guide member is provided to reciprocate between the first location and the second location two times, the second guide member is provided to reciprocate between the first location and the second location four times, and the third guide member is provided to reciprocate between the first location and the second location one time.

7. The air conditioner of claim 5, wherein the first guide rail has one end and an other end disposed in the first area, and is provided to pass through an area between the first area and the third area at least two times, and the second guide rail has one end and an other end disposed in the first area, and is provided to pass through the area between the first area and the third area at least four times.

8. The air conditioner of claim 5, wherein at least one of the first, second, and third guide rails is provided in a closed loop shape.

* * * * *